US005806810A

United States Patent [19]

Young et al.

[11] Patent Number: 5,806,810

[45] Date of Patent: Sep. 15, 1998

[54] SPRING RAIL FROG HAVING SWITCHABLE MAGNET FOR HOLDING WING RAIL OPEN

[75] Inventors: Kieth Young, Naperville; Stephen R. Kuhn, Richton Park, both of Ill.

[73] Assignee: ABC Rail Products Corporation, Chicago, Ill.

[21] Appl. No.: 980,569

[22] Filed: Dec. 1, 1997

Related U.S. Application Data

[63] Continuation-in-part of Ser. No. 939,432, Sep. 26, 1997, abandoned.

[51] Int. Cl.[6] ..... B61L 11/00; E01B 7/14

[52] U.S. Cl. ..... 246/276; 246/257; 246/265; 246/468

[58] Field of Search ..... 246/257, 258, 246/259, 265, 271, 276, 361, 468

[56] References Cited

U.S. PATENT DOCUMENTS

| | | | |
|---|---|---|---|
| 2,036,198 | 4/1936 | Cooper et al. | 246/276 |
| 2,395,164 | 2/1946 | Cole | 246/265 |
| 4,624,428 | 11/1986 | Frank | 246/276 |
| 5,417,392 | 5/1995 | Wyatt | 246/271 |
| 5,544,848 | 8/1996 | Kuhn et al. | 246/276 |

FOREIGN PATENT DOCUMENTS

| | | | |
|---|---|---|---|
| 431361 | 7/1935 | United Kingdom | 246/276 |

*Primary Examiner*—S. Joseph Morano

*Attorney, Agent, or Firm*—Thomas S. Baker, Jr.

[57] ABSTRACT

A railroad frog assembly is provided with a switched magnet that immediately retains a frog flexible wing rail in its open position in response to a railcar wheel passing through the frog assembly, and that delayably releases the frog flexible wing rail from its open position for subsequent closure by an included frog compression spring.

9 Claims, 7 Drawing Sheets

SPRING RAIL FROG HAVING SWITCHABLE MAGNET FOR HOLDING WING RAIL OPEN

CROSS-REFERENCES

This is a continuation-in-part of application Ser. No. 08/939,432, filed Sep. 26, 1997, which Application is abandoned.

FIELD OF THE INVENTION

This invention relates generally to railroad trackworks, and particularly concerns railroad frog assemblies that may be advantageously utilized in railroad trackwork intersections to obtain a prolonged operating life for each assembly.

BACKGROUND OF THE INVENTION

Numerous different configurations of fixed-point railroad frogs having spring-urged, flexible wing rails are utilized in railroad trackwork system intersections in the United States to provide through flangeways that enable railcar wheel flanges to cross intersecting rails without encountering flange physical interference. For two examples of such railroad spring rail frog configurations see U.S. Pat. Nos. 4,624,428 and 5,544,848 issued in the names of Frank and Kuhn et al., respectively, and assigned to the assignee of this patent application.

The flanged wheels of railcars passing through a fixed-point railroad frog having a spring rail and in the direction of least traffic flow repeatedly open the included flexible wing rail by the widths of the wheel flanges, and the compression springs included in the frog alternately and repeatedly force a return of the wing rail to its closed position. This oscillating action of the conventional spring-urged wing rail is undesirable in terms of both the un-necessary frictional wear and metal fatigue that are experienced.

Accordingly, a primary objective of the present invention is to provide a railroad frog construction having an included spring-urged flexible wing rail element with means for positively retaining the wing rail in its fully-opened position following its first actuation by the wheel flanges of a passing train set, and until after all the flanged wheels of the train set have passed through the frog.

Other objectives and advantages of the present invention, in addition to providing a railroad frog assembly construction with a significantly prolonged operating lifespan, will become apparent from a full consideration of the detailed descriptions, drawings, and claims which follow.

SUMMARY OF THE INVENTION

The railroad frog assembly of the present invention basically includes a frog fixed point, a frog flexible wing rail that abuts the frog fixed point when in a wing rail fully-closed position and that is spaced apart from the frog fixed point by the width of a railcar wheel flange when flexed to a wing rail fully-opened position, optional compression spring means co-operating with the frog wing rail to assist in urging the wing rail toward its fully-closed position, a switched magnet that co-operates with the flexed frog wing rail in the wing rail fully-opened position, and control means responsive to railcar wheel flanges passing through the frog assembly to automatically switch the magnet between its "on" and "off" conditions that respectively retain (hold-back) or release the frog wing rail in or from the frog wing rail fully-closed position.

DETAILED DESCRIPTION

Figure 1:
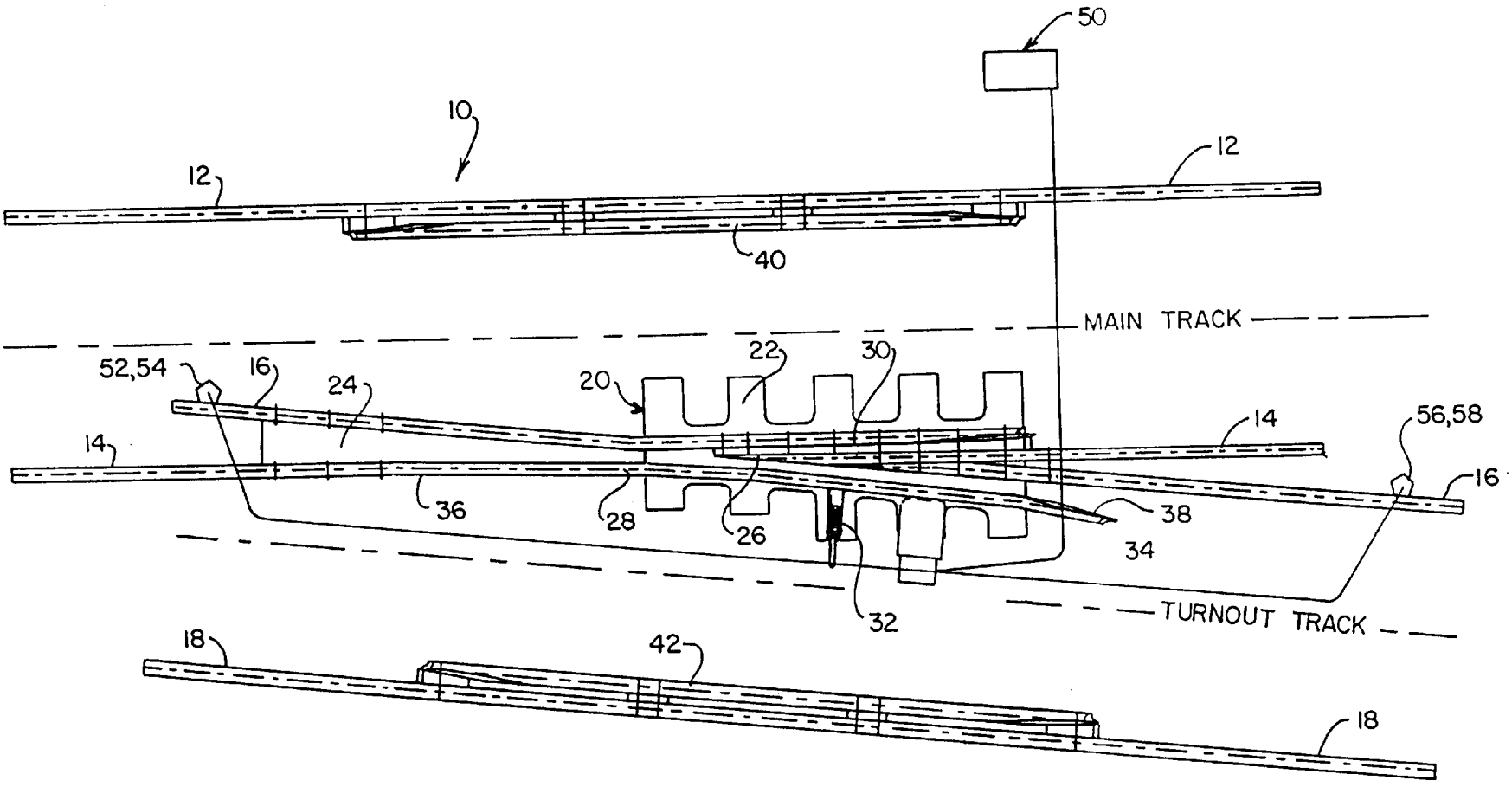
FIG. 1 is a schematic plan view of a preferred embodiment of the railroad frog assembly of the present invention illustrating the movable wing rail included in the assembly in a fully-opened position and also illustrating an included electrical control system.

FIG. 1 illustrates a right-hand railroad trackwork intersection 10 having a pair of main traffic rails 12 and 14 and a pair of turnout traffic rails 16 and 18 in which main traffic rail 14 intersects turnout traffic rail 16 at the frog assembly designated 20. Frog assembly 20 is basically comprised, in addition to its base plate elements 22 and 24, of a frog fixed point 26 (sometimes referred to as a frog "V-point"), a frog flexible wing rail 28, a frog fixed wing rail 30, an optional compression spring closer element 32 that supplements internal compressive forces within the flexed wing rail element when that wing rail element is moved to its fully closed condition, and a normally "off", switched magnet element 34. In FIG. 1, flexible wing rail 28 is illustrated in its open position to thus provide a flangeway through the assembly for the flanges of railcar wheels riding on turnout traffic rail 16. Flexible wing rail 28 essentially abuts the side of fixed point 26 when in its closed position, and is flexed or pivoted laterally about the point designated 36 to an open condition whenever the flange of a railcar wheel traversing the frog assembly either first engages the side of closed flexible wing rail 28 to the left (FIG. 1) of V-point 26 or engages the side of movable wing rail element 28 at its flared end portion 38. Also included in trackwork intersection 10, but not comprising a part of the present invention, are conventional intersection rigid guard rails 40 and 42.

Figure 3:
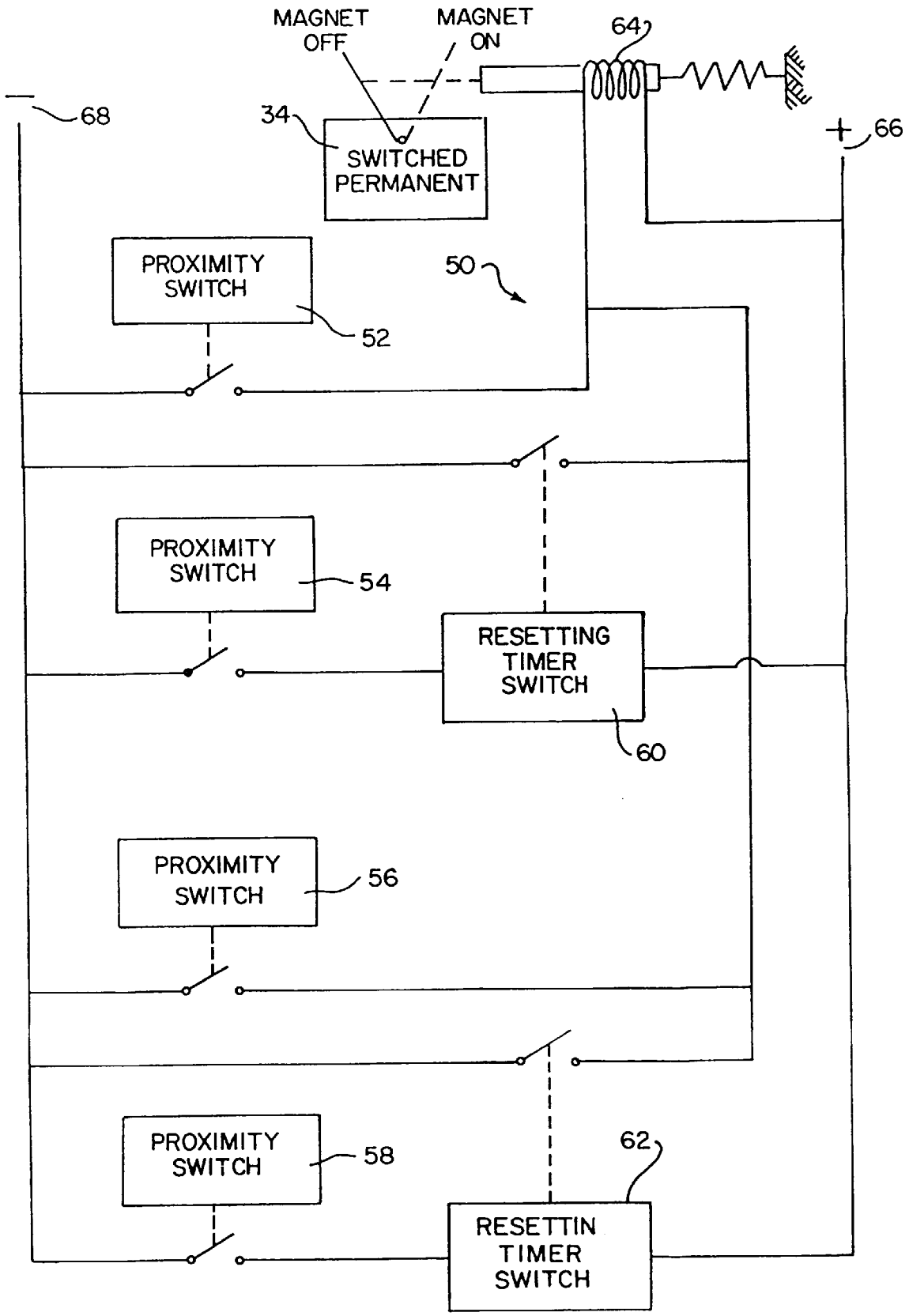
FIG. 3 is a schematic illustration of the electrical control system included in the railroad frog assembly of FIG. 1.

Additionally, frog assembly 10 is comprised of an electrical control system 50 that actuates switched magnet means 34 between its "on" and "off" conditions in response to sensing the presence or absence of railcar wheels passing through the assembly. Switched magnet means 34 may be either a conventional permanent magnet or alternatively a conventionally-energized electro-magnet. Magnet element 34 is activated when it is switched "on" and de-activated when it is switched to an "off" condition. In the "on" condition magnet 34 will magnetically attract and hold flexible wing rail 28 in an open condition. In the "off" condition flexible wing rail 28 is free to move, either with or without the additional urging of a spring closer element 32, to a closed condition abutting the side of fixed rail 26. Referring to FIG. 3 in particular, electrical control system 50 may be essentially comprised of wheel sensor switches 52 through 58, resetting timer switches 60 and 62, an actuating solenoid 64 mechanically coupled to switched magnet means 34, and circuit conductors interconnecting those components to the positive and negative terminals 66 and 68 of a conventional electrical power source in the manner shown. Sensor switches 52 through 58 may each have a conventional proximity switch configuration, a conventional load cell configuration, or the like—their function in the invention being to detect and positively respond to the presence of an adjacently-positioned railcar wheel. The railroad frog assembly system sensors preferably are positioned adjacent the exterior side of turnout traffic rail 16, which rail is most often a traffic rail of least traffic density, and each functions to sense the immediate presence or absence of a flanged railcar wheel passing through the intersection. If the immediate presence of a railcar wheel is sensed by a proximity switch or load cell that component's switch element is closed, otherwise the sensor switch element normally remains open.

Preferably, sensor switches 52 and 54 are paired and are located near one extreme of frog assembly 20. Similarly, sensor switches 56 and 58 are also paired and are located near the other extreme of frog assembly 20. Wheel sensor switches 52 and 56 function to complete a power circuit to and through actuating solenoid 64 mechanically coupled to switched magnet means 34. Sensor switches 54 and 58, on the other hand, function to complete a power circuit to and through a respective one of normally-open, resetting timer switches 60 and 62. Such timer switches are preferably of an adjustable type, and have a pre-set time period for switch element closure. A closure delay period of approximately 45 seconds is presently preferred. Thus, in response to each sensing of an immediately-near railcar wheel passing through frog assembly 10 and consequent switch closing by a wheel sensor switch, its respective resetting timer switch 60 or 62 will keep solenoid 64 actuated (energized) for a following 45 seconds or other pre-set time period. Thus, following a period after the last train set railcar wheel has passed through the intersection, all of sensor switches 52 through 62 will be in an "open" condition, solenoid 64 will be de-activated, switched magnet 34 will be in an "off" condition, and, since movable wing rail 28 is no longer retained in an open condition, frog compression spring 32 will force that rail to its closed position.

Figure 2:
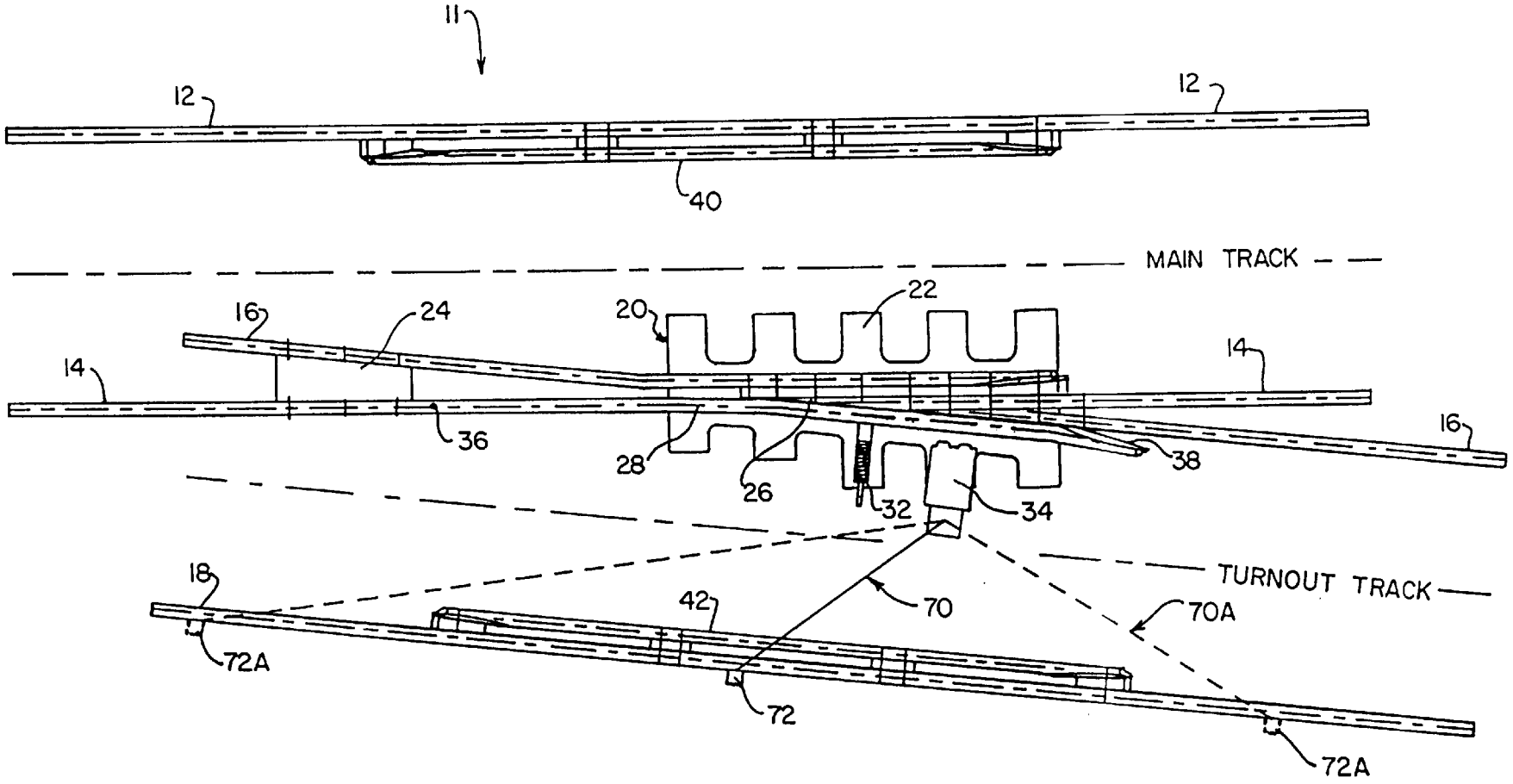
FIG. 2 is similar to FIG. 1 except that the included wing rail element is illustrated in a fully-closed position and that the included control system is a hydraulic control system.

FIG. 2 schematically illustrates a railroad trackwork intersection 11 having components 12 through 42 that are similar to the like components of intersection 10 but having a hydraulic control system 70 rather than an electrical control system such as control system 50 for regulating the switching of switched magnet means 34 between its "on" and "off" conditions. Control system 11 is particularly distinguished by the inclusion of a railcar wheel-activated, single-acting, spring-return mechanical pump element 72 that functions both as a sensor of the presence or absence of each railcar wheel passing through frog assembly 20 and as an energy source for powering control system 11. Also, FIG. 2 illustrates, using broken lines, the schematic placement of a pair of wheel-activated mechanical pumps 72A of an alternate-configuration control system 70A that may be utilized as an alternate to control system 70.

Figure 4:
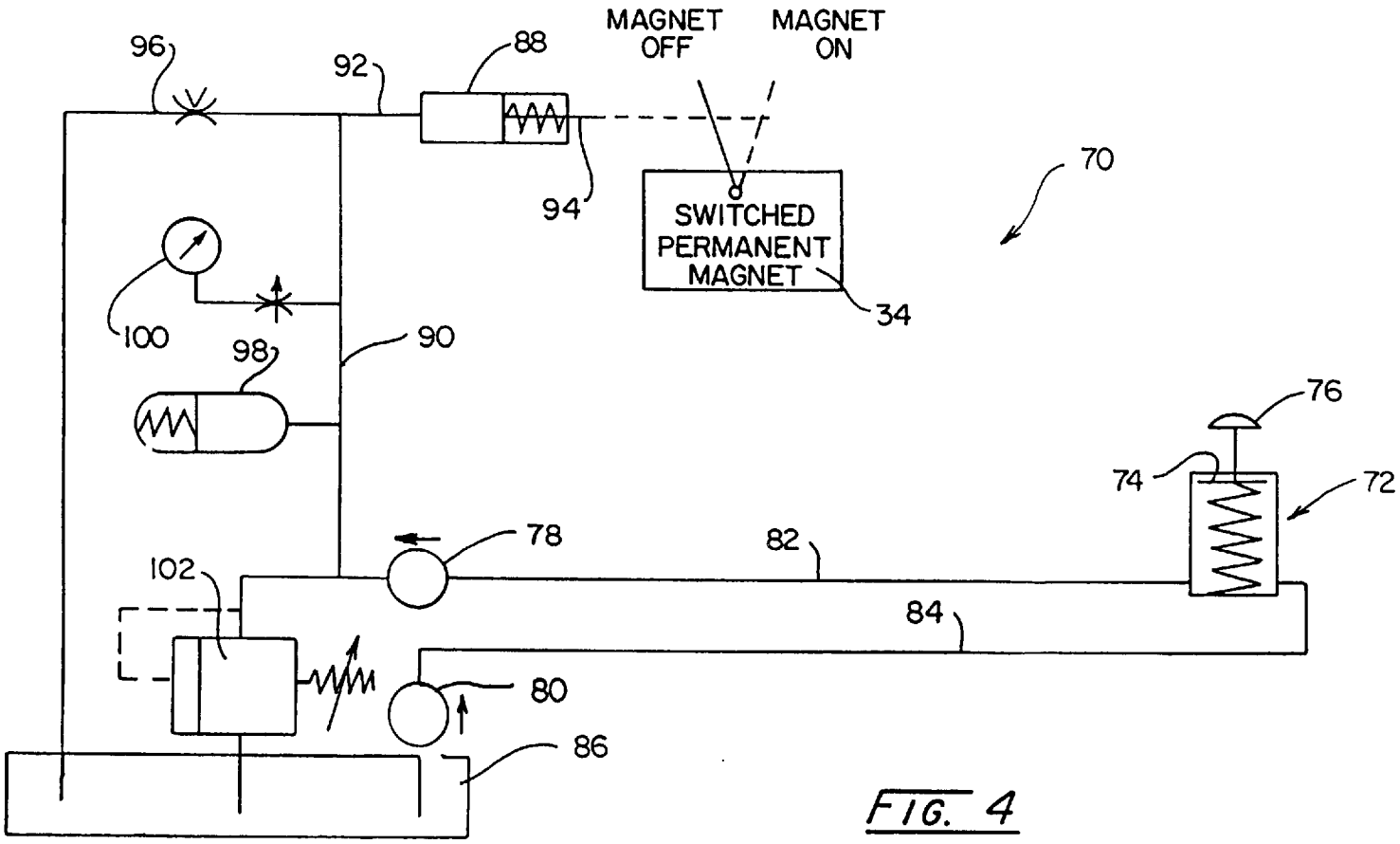
FIG. 4 is a schematic illustration of the hydraulic control system included in the railroad frog assembly of FIG. 2.

FIG. 4 provides additional details of the hydraulic elements preferably included in control systems 70 or 70A. Element 72 is the above-mentioned single-acting, spring-return mechanical pump and has an internal piston element 74 that is connected to a reciprocable, wheel-actuated plunger element 76. Pump element 72 is made a single-acting pump by reason of the check valves 78 and 80 included in connecting hydraulic fluid flow lines 82 and 84. Internal compression spring element 78 of mechanical pump 72, in the absence of wheel tread forces imposed on plunger element 76, urges piston element 74 to the position shown in FIG. 4.

As the wheel treads of successive railcars passing through frog assembly 11 repeatedly depress plunger element 76 pressurized hydraulic fluid is pumped from reservoir 86 to single-acting, spring-return hydraulic actuator 88 via fluid flow lines 90 and 92. The piston rod element 94 of hydraulic actuator 88 is mechanically coupled to the actuating arm of switched magnet element 34. Hydraulic system 70 also includes an adjustable bleed-off valve 96, a conventional spring-powered pressure accumulator 98, a valved pressure gage 100, and an adjustable pressure relief valve 102 set for system maximum pressure. System relief valve 102 is set to hold a system pressure that is significantly greater than the pressure required at actuator 88 to overcome the spring forces of actuator 88/magnet 34 and thereby switch the magnet from its normal "off" condition to its "on" condition. Bleed-off valve 96 is adjusted to control the rate of fluid flow from line 92 where such rate establishes a predetermined time delay (e.g., 45 seconds) between the time the last railcar wheel of a train set passing through frog assembly 11 depresses pump plunger 76 and time that permanent magnet 34 is switched to its normal "off" condition.

Should a train set stop before the its last railcar wheel has cleared the frog assembly, permanent magnet 34 will be switched off following the preset delay and wing rail 28 will be prematurely closed by compression spring element 32. However, the arrival of the next railcar wheel to pass either a sensor switch (52 or 54) or a wheel-actuated pump (72 or 72A) will cause its respective control system to return magnet 34 to its switched "on" condition thereby retaining wing rail 28 in its open position until such time as the preset time delay has elapsed following passage of the last train set railcar wheel.

Figure 5:
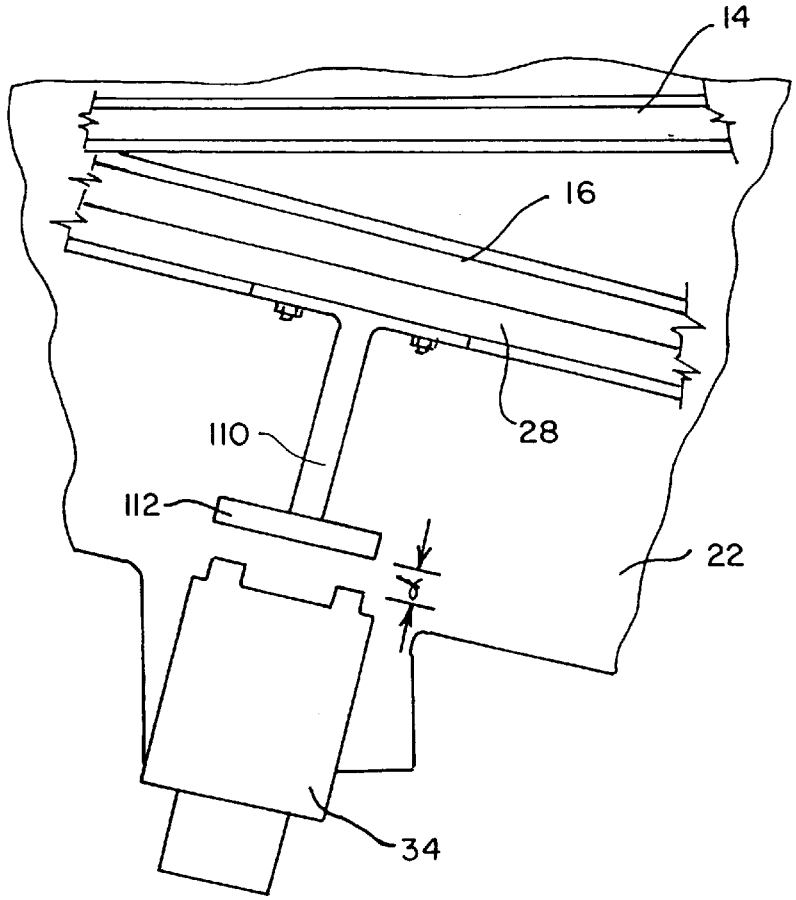
FIG. 5 is a plan view of a portion of a railroad frog assembly in accordance with the present invention but having a modified arrangement for functionally coupling the frog assembly flexible wing rail element to the included wing rail hold-back switched magnet element.

Depending upon particular application requirements, different modifications may be advantageously made to the arrangement of invention elements illustrated in FIGS. 1 and 2. In FIG. 5, for instance, we illustrate the advantageous inclusion in the invention of a rail horn fitting 110 which is securely bolted to the frog flexible wing rail 28 with its longitudinal axis oriented substantially at right angles to the longitudinal axis of the wing rail, and which is positioned intermediate flexible wing rail 28 and switched magnet means 34. Horn fitting 110 is provided with an attached (as by welding) attraction face element 112 that is oriented substantially at a right angle relative to the longitudinal axis of horn fitting 110. Attraction face element 112 engages, and is retained in position by, switched magnet means 34 when switched on and after flexible wing rail 28 has been moved from its FIG. 5 closed condition through the distance d by the action of the flange of a railcar wheel passing through the frog assembly. As previously suggested, the distance d generally equals or is slightly greater than the flange thickness of a standard railcar wheel. The FIG. 5 modification for railroad frog assembly 10 is advantages when it is desired to locate switched magnet means 34 and it switched magnetic flux field more distant from wing rail 28 than as shown in FIGS. 1 and 2.

Figure 6:
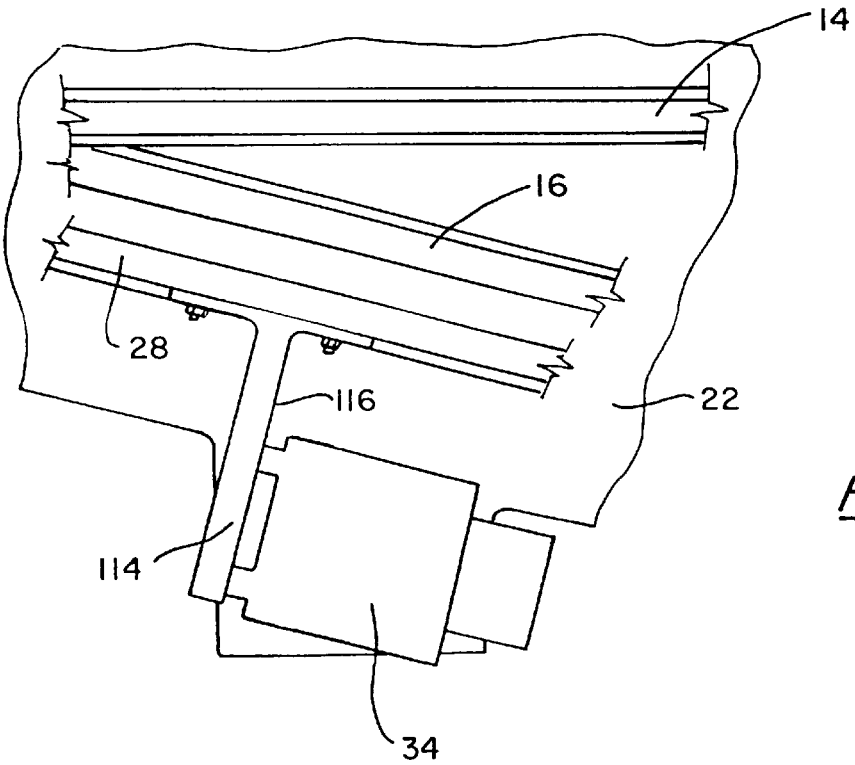
FIG. 6 is similar to FIG. 5 but illustrating another modified arrangement of invention elements.

In FIG. 6 we schematically illustrate another invention modification involving the use of an intermediately-positioned rail horn fitting. The FIG. 6 horn fitting is referenced with the numeral 114 and is similar to horn fitting in function but does not include an attached right-angled attraction face element. Instead, horn fitting 114 is provided with a solid side 116 that faces switched magnet means 34. Solid side 116 provides an attraction face that engages and is retained by switched magnet means 34 when the magnet is switched on. As in the FIG. 5 arrangement, through use of the attached and intermediately positioned horn fitting 114, switched magnet means 34 may be positioned farther from flexible wing rail 28 than in the FIG. 1 and FIG. 2 arrangements.

Figure 7:
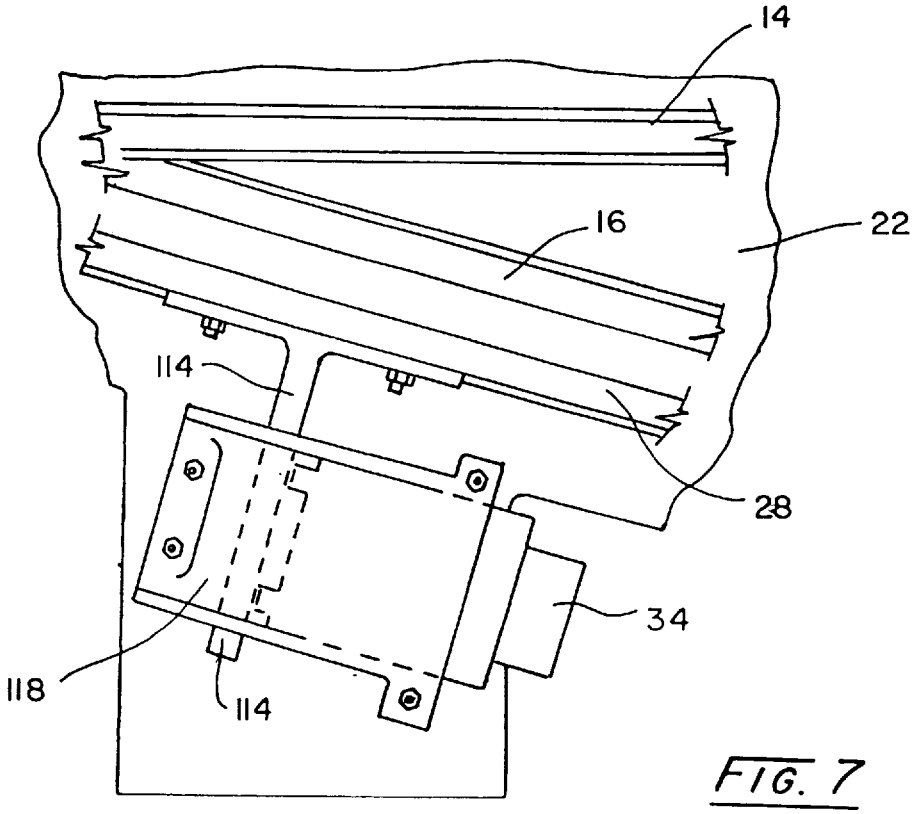
FIG. 7 is similar to FIGS. 5 and 6 but illustrating still another element arrangement modification.

In FIG. 7 we illustrate an arrangement of invention elements which is somewhat similar to the arrangement of FIG. 6 save that horn fitting 114 also co-operates with a conventional flexible wing rail hold-down fitting 118 of the type disclosed in U.S. Pat. No. 5,595,361 issued in the name of Remington et al.

Figure 8:
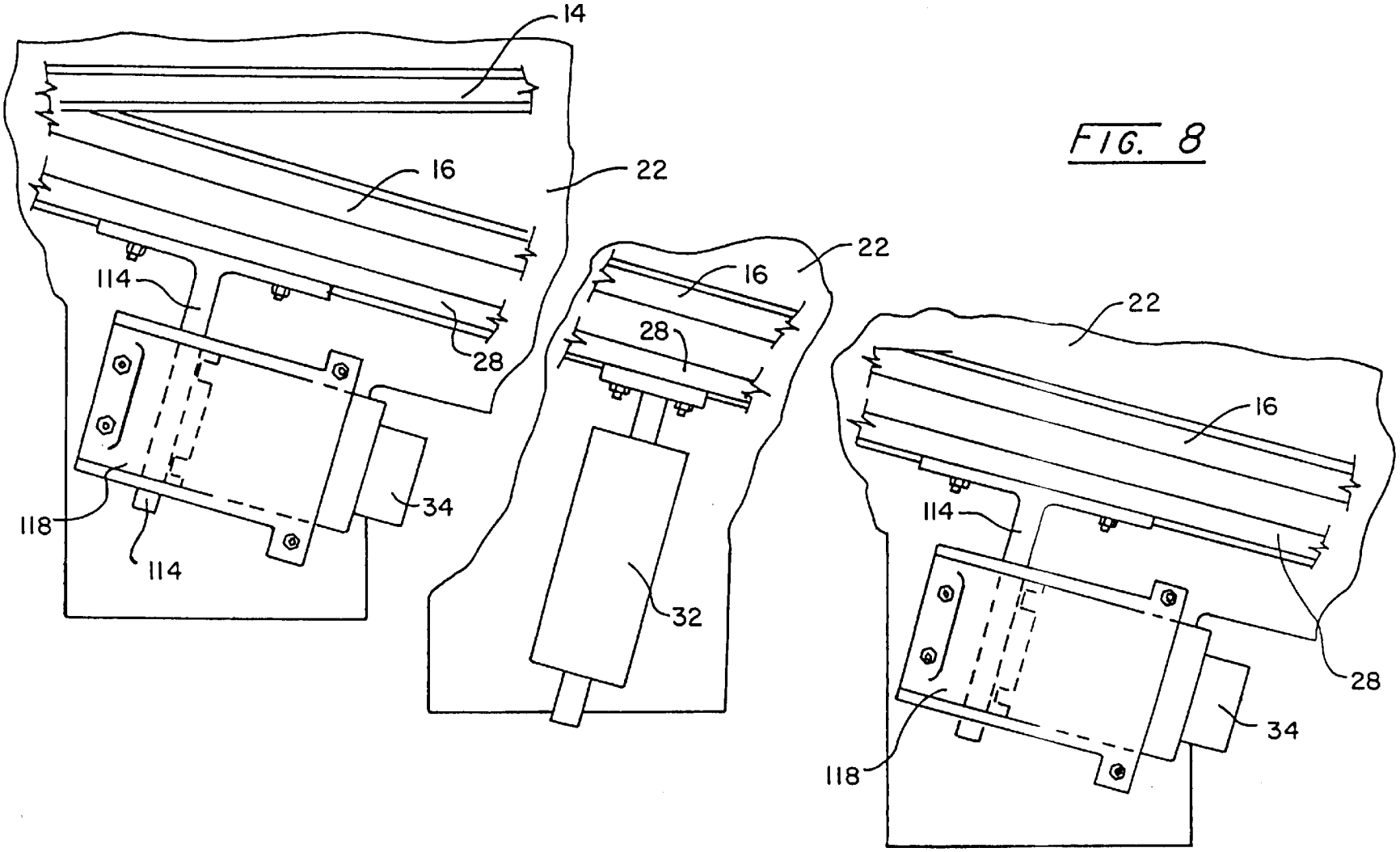
FIG. 8 is a plan view of portions of a railroad frog assembly in accordance with the present invention but utilizing multiple switched magnet elements to retain the invention flexible wing rail in its fully-open condition.

Also, and as illustrated in the drawings at FIG. 8, in some applications of railroad frog assembly 10 it is advantageous to utilize multiple switched magnet elements 34 spaced apart along the longitudinal axis of flexible wing rail element 28. The FIG. 8 arrangement illustrates the use of two such switched magnet elements separated by an intermediately-positioned closure spring element 32.

Various changes may be made in the relative shapes, proportions, and sizes of the components disclosed without departing from the scope, meaning, or intent of the claims which follow.

We claim our invention as follows:

1. A railroad trackwork frog assembly comprising:

a frog fixed point element;

a frog wing rail element that may be flexed laterally from a closed position abutting said frog fixed point element to an open position separated from said frog fixed point element by a minimum distance equal to the width of a railcar wheel flange;

a switched magnet element having an "off" condition and an "on" condition, and contacting and retaining said frog wing rail element in its open position when actuated to an "on" condition; and control means actuating said switched magnet element between said magnet element "on" and "off" switched conditions, said control means responding to the presence of a railcar wheel to actuate said switched magnet element to a switched "on" condition, and to additionally delayably actuate said switched magnet element to a switched "off" condition.

2. The railroad frog assembly defined by claim 1, and wherein said control means comprises a railcar wheel-activated mechanical pump that pressurizes hydraulic fluid in response to the sensed presence of a railcar wheel, a hydraulic actuator that is operably connected to said switched magnet element and that contains hydraulic fluid pressurized by said railcar wheel-activated mechanical pump, and bleed-valve means that controllably reduces the pressure of hydraulic fluid contained in said hydraulic actuator.

3. The railroad frog assembly defined by claim 2, and wherein said control means railcar wheel-activated mechanical pump is a single-acting, spring-return mechanical pump, and said hydraulic actuator is a single-acting, spring-return actuator.

4. The railroad frog assembly defined by claim 1, and wherein said control means comprises a switched electrical solenoid actuator connected to said switched magnet element in switching relation, a sensor switch connected to a source of electrical power and to said switched electrical solenoid actuator, and a timer switch connected to said sensor switch and to said switched electrical solenoid actuator in switching relation.

5. The railroad frog assembly defined by claim 4, and wherein said control means timer switch is a resetting timer switch responsive to each railcar wheel passing through the frog assembly.

6. The railroad frog assembly defined by claim 1, and wherein a horn fitting element is positioned intermediate, and co-operates with, said frog wing rail element and said frog switched magnet element, said horn fitting element having an attraction face that is selectively engaged with said frog switched magnet element.

7. The railroad frog assembly defined by claim 6, and wherein said horn fitting element attraction face is rigidly positioned and oriented parallel to the longitudinal axis of said frog wing rail element.

8. The railroad frog assembly defined by claim 6, and wherein said horn fitting element attraction face is rigidly positioned and oriented at right-angles relative to the longitudinal axis of said frog wing rail element.

9. The railroad frog assembly defined by claim 1, further comprising a plurality of switched magnet elements each having an "off" condition and an "on" condition, and spaced along said frog wing rail element, and each containing an retaining said frog wing rail element in its open position when actuated to an "on" condition.

* * * * *